US008726545B2

(12) United States Patent
Parienti

(10) Patent No.: US 8,726,545 B2
(45) Date of Patent: May 20, 2014

(54) FOLD-AWAY IRONING DEVICE WITH STEAM GENERATOR

(76) Inventor: Raoul Parienti, Nice (FR)

( * ) Notice: Subject to any disclaimer, the term of this patent is extended or adjusted under 35 U.S.C. 154(b) by 0 days.

(21) Appl. No.: 13/977,818

(22) PCT Filed: Jun. 12, 2011

(86) PCT No.: PCT/FR2011/000640

§ 371 (c)(1),
(2), (4) Date: Aug. 1, 2013

(87) PCT Pub. No.: WO2012/076772

PCT Pub. Date: Jun. 14, 2012

(65) Prior Publication Data

US 2013/0333255 A1 Dec. 19, 2013

(30) Foreign Application Priority Data

Dec. 7, 2010 (FR) ..... 10 04759

(51) Int. Cl.
*D06F 81/06* (2006.01)
*D06F 81/00* (2006.01)

(52) U.S. Cl.
USPC ..... 38/104; 108/39; 312/321.5

(58) Field of Classification Search
USPC ..... 38/103–139; 108/33–40; D32/9, 66; 312/237, 240, 321.5
See application file for complete search history.

(56) References Cited

U.S. PATENT DOCUMENTS

| | | | | | |
|---|---|---|---|---|---|
| 1,464,352 | A * | 8/1923 | Cox | 297/14 |
| 1,892,117 | A * | 12/1932 | Perkins | 99/388 |
| 1,949,845 | A * | 3/1934 | Shingle | 108/33 |
| 3,641,947 | A * | 2/1972 | Finney | 108/38 |
| 3,663,080 | A * | 5/1972 | Ayers | 312/237 |
| 4,961,388 | A * | 10/1990 | Simpson | 108/42 |
| 7,310,899 | B1 * | 12/2007 | Costa et al. | 38/137 |
| 2013/0154459 | A1 * | 6/2013 | Murphy et al. | 312/237 |

FOREIGN PATENT DOCUMENTS

| | | | |
|---|---|---|---|
| EP | 2167721 | A2 | 3/2010 |
| GB | 765105 | A | 1/1957 |
| GB | 2389372 | A | 12/2003 |
| GB | 2389372 | A * | 12/2003 |
| WO | 2007077342 | A2 | 7/2007 |

OTHER PUBLICATIONS

International Search Report mailed Mar. 23, 2012, corresponding to International Patent Application No. PCT/FR2011/000640.

* cited by examiner

*Primary Examiner* — Ismael Izaguirre
(74) *Attorney, Agent, or Firm* — Ladas & Parry LLP

(57) ABSTRACT

Fold-away ironing device comprising a frame (12) attached to the wall and in which there is an ironing board surrounded by a mobile frame (18). In a first position, the ornamental front part is visible in the frame fixed to the wall and the ironing board is folded away, and in the second position, the front part is folded away and the ironing board becomes visible. First pivot means comprising a top hinge and a bottom hinge at the right-hand end or at the left-hand end of the frame fixed to the wall forming a vertical axis allowing the ironing board to be pivoted through an angle of around 90° and, on the other hand, two hinges situated at the middle of the horizontal parts of the mobile frame forming the vertical axis (20) allowing the ironing board to pivot so that it becomes visible. Second pivot means allow the ironing board in the second position to be moved from the vertical position into the horizontal position.

11 Claims, 4 Drawing Sheets

FOLD-AWAY IRONING DEVICE WITH STEAM GENERATOR

TECHNICAL FIELD

The present invention relates to foldaway utility objects installed in apartments or hotels, and relates in particular to a foldaway ironing board and iron.

PRIOR ART

The iron and the ironing table associated with it are among the essential utility objects in a house and which a housekeeper uses frequently. However, in spite of improvements such as the use of steam, ironing is still a chore because the tool is difficult to implement. Indeed, it is always tiresome to take the board out of a closet, often crammed, then to install it. And afterward, it is necessary to find the iron, plug it in, and, finally, when the work is done, all of these operations must be performed in reverse.

Some products that have recently been placed on the market have a closet with a board inside it. These have the disadvantage of being bulky, unattractive and not very functional. Moreover, the door of such a closet, remaining open during use, may impede the user in his or her work.

A foldaway linen ironing assembly is described in document GB-A-2 389 372. This assembly includes a frame attached to the wall in which an ironing board is located, having a rear portion having an ironing surface and a front portion integral with the rear portion constituting a decorative surface or a mirror. The board may adopt a first position in which the front portion is visible and the rear portion is folded away, and a second position in which the front portion is folded away and the rear portion is made visible. To do this, the rear portion has pivoting means suitable for moving the ironing board from the first position to the second position, and for moving the ironing board in the second position from the vertical position to the horizontal position, as a bracket so that a user can use the ironing surface.

Document GB 765105 describes a foldaway ironing device including a frame attached to the wall and forming a cavity in which an ironing board is located, the cavity being obstructed by a door hiding the ironing board when it is closed. Unlike the preceding document, the ironing board of this document does not have a front portion integral with the rear portion constituting a decorative surface or a mirror, and cannot adopt a first position in which the front portion is visible in the frame attached to the wall and the rear portion is folded away, and a second position in which the front portion is folded away and the rear portion is made visible in the frame attached to the wall.

In document EP 2 167 721, the improved foldaway assembly described has an ironing board having a rear portion having an ironing surface and a front portion integral with the rear portion constituting a decorative surface or a mirror. The board may adopt a first position in which the front portion is visible in the frame attached to the wall and the rear portion is folded away, and a second position in which the front portion is folded away and the rear portion is made visible in the frame. First pivoting means make it possible to move the ironing board from the first position to the second position and vice versa, and second pivoting means make it possible to move the ironing board in the second position from the vertical position inside the frame to the horizontal position as a bracket so that a user can use the ironing surface. The first pivoting means are formed by a carriage supporting a frame surrounding the rear portion and in particular the ironing surface, the carriage being moved laterally from one edge to the other of the frame by means of wheels rolling on each side of a guide rail so as to cause the ironing board to move from the first position to the second position and vice versa.

Consequently, the assembly described above has mechanical rotating parts such as the carriage, which moves laterally in order to ensure the opening and closing, and of which the wheels are spring-mounted so as to ensure a rectilinear movement, making it extremely fragile and subject to premature wear. In addition, the carriage takes up significant space both in width and in height, thereby considerably limiting the useful surface for the ironing board inside its frame. Another disadvantage of this assembly is that it is bulky and heavy and the ratio of the useful width of the board to the total width does not enable a compact design.

DESCRIPTION OF THE INVENTION

For this reason, the aim of the invention is to provide a device having an ironing board and an iron that can easily be folded away against a wall, having the appearance of a mirror or a painting and also quickly unfolded so as to be capable of being functional immediately, without using rotating mechanical parts, reducing the useful surface for the ironing board.

The invention therefore relates to a foldaway device for ironing linens including a frame attached to the wall in which an ironing board is located surrounded by a mobile frame and having a rear portion having an ironing surface and a front portion integral with the rear portion constituting a decorative surface or a mirror. The ironing board can adopt a first position in which the front portion is visible in the frame attached to the wall and the rear portion is folded away, and a second position in which the front portion is folded away and the rear portion is made visible in the frame attached to the wall. The device has first pivoting means suitable for moving the ironing board from the first position to the second position, and vice versa, and second pivoting means for moving the ironing board in the second position from the vertical position to the horizontal position as a bracket so that a user can use the ironing surface. The first pivoting means include two top and bottom hinges located at the right-hand or at the left-hand end of the frame attached to the wall and forming a vertical axis enabling the mobile frame and the ironing board to pivot in the counterclockwise direction (or vice versa) about the vertical axis of an angle by around 90° so as to make the ironing board visible, and include two top and bottom hinges located, respectively, in each of the horizontal portions of the mobile frame and at their middle forming a vertical axis enabling the ironing board to pivot in the clockwise direction (or vice versa) so as to make the ironing board visible in the frame attached to the wall.

BRIEF DESCRIPTION OF THE DRAWINGS

The aims, objectives and features of the invention will become clearer in view of the following description, with reference to the drawings, wherein.

DETAILED DESCRIPTION OF THE INVENTION

Figure 1:
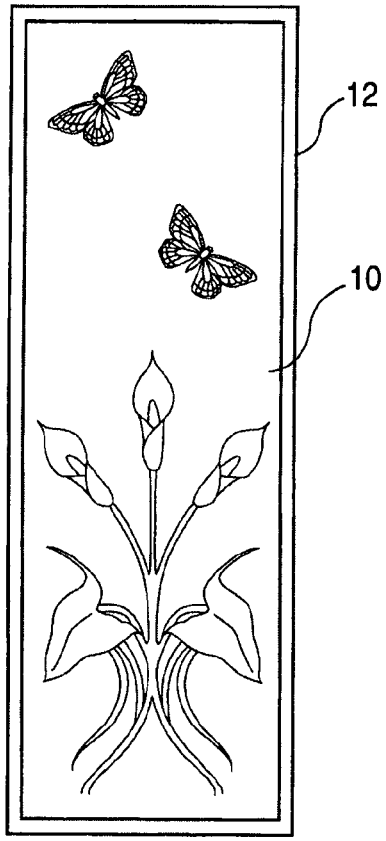
FIG. 1 shows the ironing board and iron device according to the invention folded away and leaving the decorative portion visible.

In reference to FIG. 1, the ironing board has, in a first position, a front portion 10 that is a decorative surface such as a table or a mirror inside a frame 12 attached to the wall.

Behind the front portion, a rear portion is formed by the ironing board and the steam iron associated with modern ironing devices such as a brush integrating a perforated tube enabling a steam jet to be sprayed on a linen placed on the board.

As described below, when the decorative surface or the mirror is visible, the rear portion is folded away in a cavity of the wall inside the frame 12.

FIGS. 2A, 2B, 2C and 2D show the phases of positioning the rear portion. In reference to FIG. 2A, the ironing board device is first removed from the cavity by pivoting. To do this, the left edge is released from a mobile frame 18 that surrounds the ironing board and this frame is pivoted in the counter-clockwise direction about two hinges (not shown) located at the top and at the bottom of the cavity 14, the two hinges constituting a vertical pivoting axis. Initially, the board can be kept locked in the cavity by any suitable mechanism that becomes unlocked when a slight pressure is exerted on the ironing board.

It should be noted that, although the two hinges are placed at the right-hand side of the frame 12 in the embodiment shown, they may be located at the left-hand side of this cavity and pivot the board in the clockwise direction without going beyond the scope of the invention.

Figure 2A:
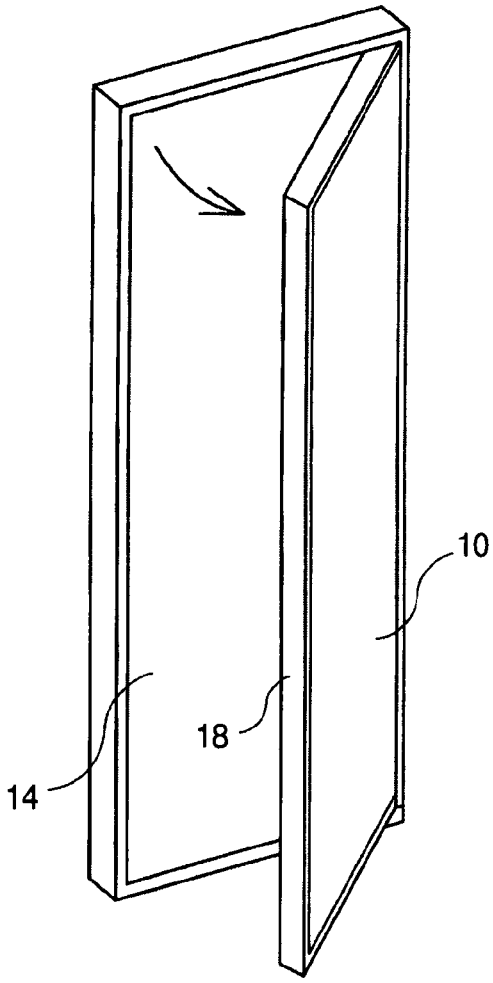
FIGS. 2A, 2B, 2C and 2D show the successive pivoting phases for making the ironing board visible.
Figure 2B:
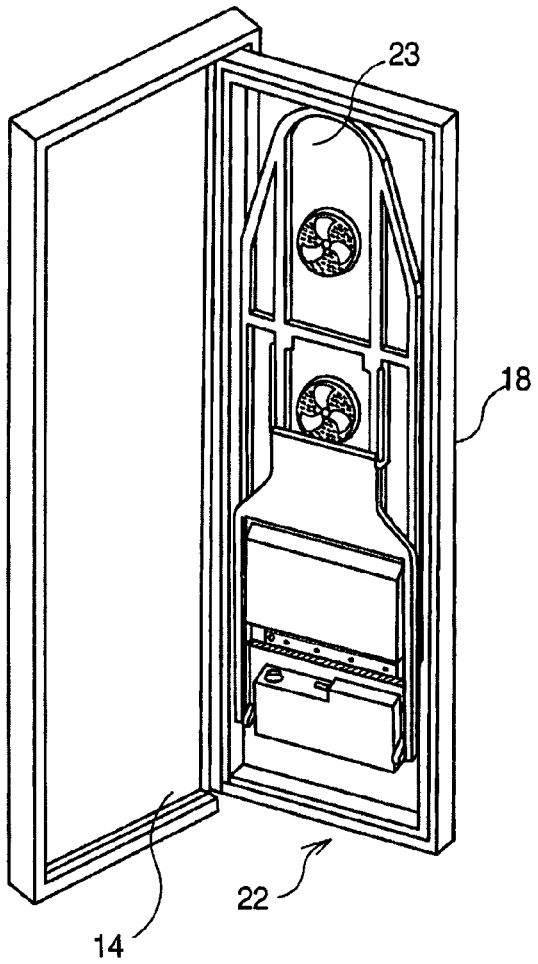

When the frame 18 containing the ironing board has pivoted by around 90° as shown in FIG. 2B, the rear portion 22 containing the ironing board becomes visible and shows the bottom 23 of the ironing board.

Figure 2C:
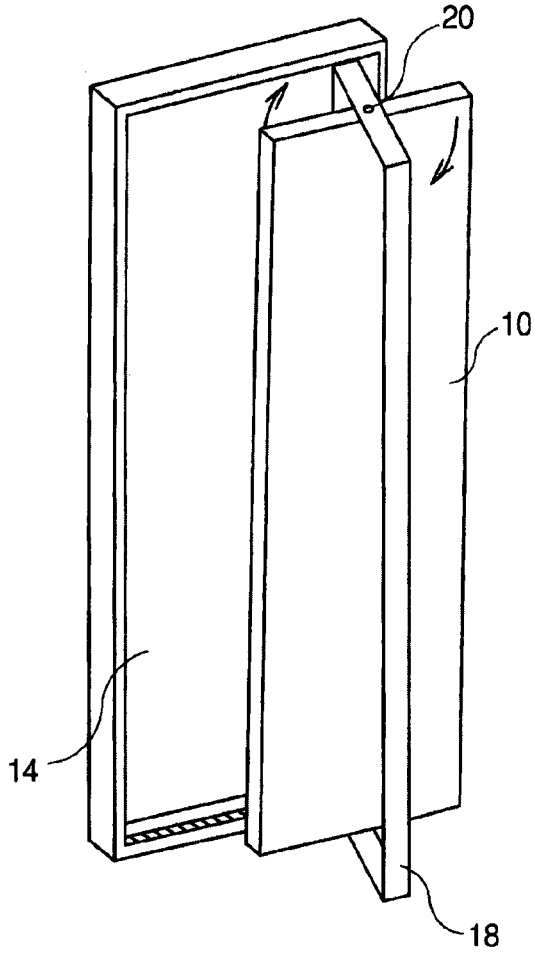

The next action shown in FIG. 2C consists of pivoting the ironing board in the clockwise direction about a vertical axis 20 formed by two top and bottom hinges located respectively in each of the horizontal portions of the mobile frame 18 and at their middle.

Figure 2D:
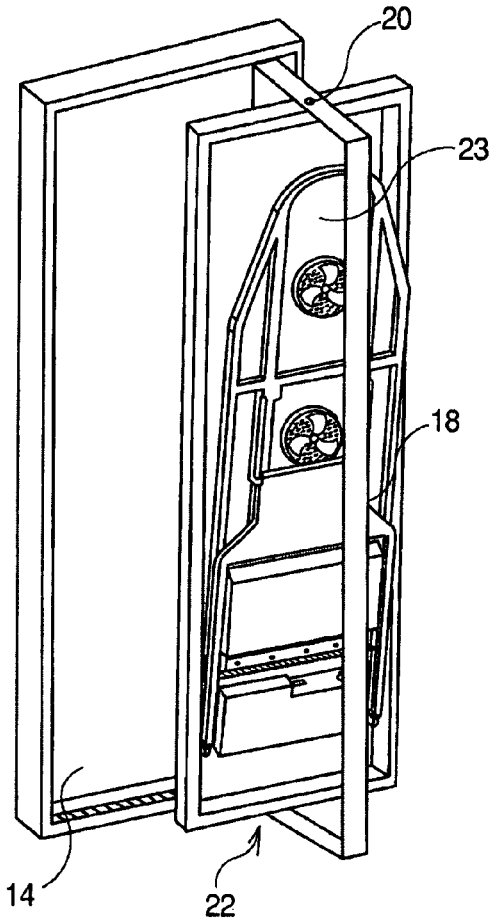

When the ironing board has pivoted by 90° or more as shown in FIG. 2D, the rear portion 22 of the device containing the ironing board is located on the front. The next action is a pivoting movement that consists of bringing the frame 18 back into the cavity 14, the frame driving the ironing board in its movement and requiring it to be placed in the cavity 14 while being surrounded by the mobile frame 18. At the end of the actions described above, the rear portion 22 of the device showing the bottom 23 of the ironing board has thus taken the place of the front portion, i.e. the decorative surface or the mirror. It should be noted that, as these actions are performed, the ironing board has undergone a 180° rotation.

Figure 3A:
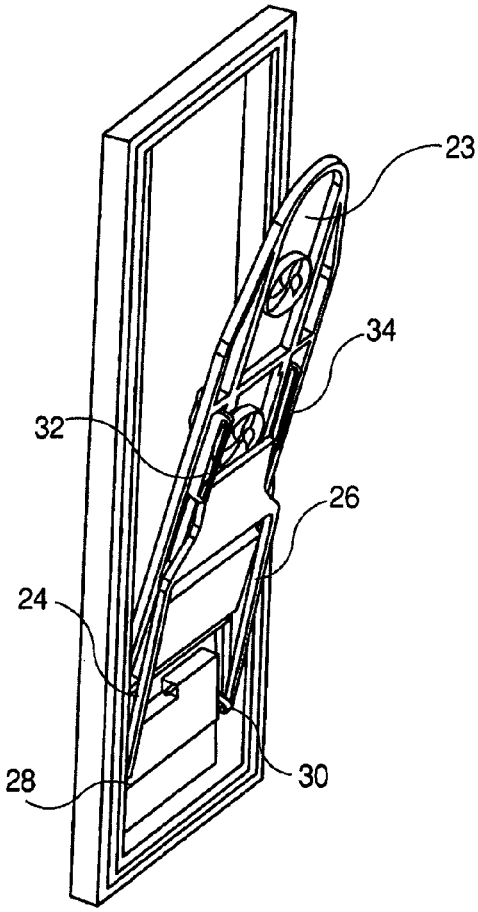
FIGS. 3A and 3B show the successive pivoting phases for placing the ironing surface in the use position.
Figure 3B:
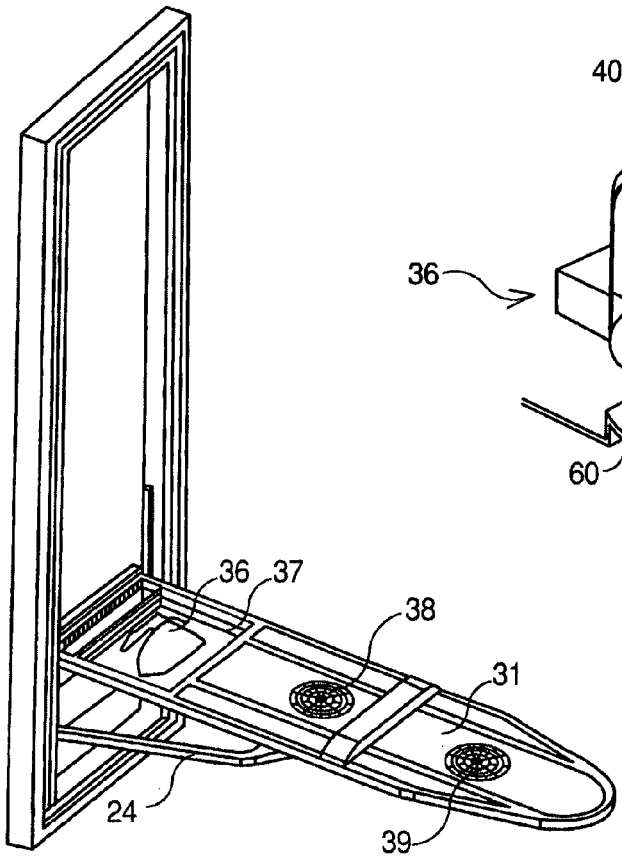

When the ironing board is made visible, as explained above, it is positioned as a bracket according to the phases shown in FIGS. 3A and 3B. This operation consists of removing the ironing board from its frame and folding it up by pivoting it by 90° owing to two hinges (not shown) located at the bottom of the ironing board and on each side and which are integral with the frame 18.

The bracket support suitable for holding the ironing board in the horizontal position, visible in FIG. 3A, has two arms 24 and 26 of which the ends 28 and 30 rest in the bottom portion of the frame 18. When the ironing surface pivots as shown in FIG. 3A, the two arms of the bracket support that have, at their upper ends, lugs held by sliding respectively into grooves 32 and 34 located under the ironing table, pivot around two lugs located at the lower ends 28 and 30 of the bracket support.

After a 90° pivot of the ironing board, it adopts a horizontal position that is its end position, with the ironing surface 31 being located on top. Once it has reached this position, the ironing board is immobilized as the ends of the two arms 24 and 26 of the bracket support respectively reach the ends of the grooves 32 and 34.

It should be noted that it is possible to provide locking means such as holes located in the grooves 32 and 34 into which lugs are inserted, which lugs are located at the ends of the arms 24 and 26 urged by springs thus enabling the ironing board in the horizontal position to be immobilized in the working position.

The appliance used for ironing, such as an iron 36, equipped with its handle 40 in the folded position is in a stowed position in a cavity 37 at the end of the ironing surface near the wall, as shown in FIG. 3B. It should be noted that, in this stowed position, the handle 40 is in the folded position adjacent to the soleplate 42.

As mentioned above, the iron 36 is a steam iron. The board is therefore equipped on its surface with a suitable grill enabling the steam to circulate through the linens to be ironed.

The system also includes recent known ironing improvements, namely:

1) the board is equipped with fans 38 and 39 of which the rotation in one direction enables steam to be propelled toward the outside of the board and upward so that said steam passes through the linens placed on the board. To do this, the board is connected by a steam duct to a heating container (not shown), which generates steam.

2) by rotating the fans 38 and 39 in the other direction, an air flow is directed downward, and causes a suction, which enables the linens to be ironed to be pressed on the board and largely facilitates the action of the steam iron or the steam duct for ironing the linens. For this function, the board is equipped with means for discharging suctioned air.

According to an alternative, the appliance used for ironing consists of a brush integrating a perforated tube that is connected to the end piece of the steam duct connected to the heating chamber that produces steam. This brush is implemented by the user by means of a gripping handle in order to cause it to glide over the linens to be ironed placed on the board. The emission of the steam flow emitted by the brush onto the linens enables quick ironing.

The heating container can be connected and disconnected instantly by means of an ad hoc device, either to the steam iron or to the brush integrating a perforated tube.

According to another embodiment, the heating container is integrated at the end of the board and the other end of the board (rounded portion) integrates the cavity 37 that enables the iron and the brush to be stowed.

Aside from the steam duct, a power cable makes it possible to ensure the electrical power supply of the iron and the transmission of commands for all of the functions useful for ironing.

Figure 4:
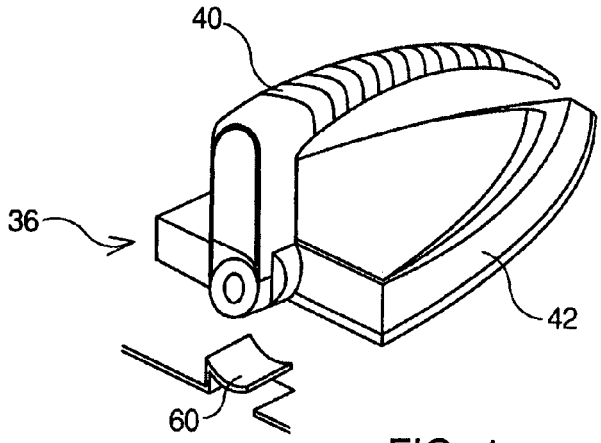
FIG. 4 shows a perspective view of the ironing board ready for use.
Figure 5:
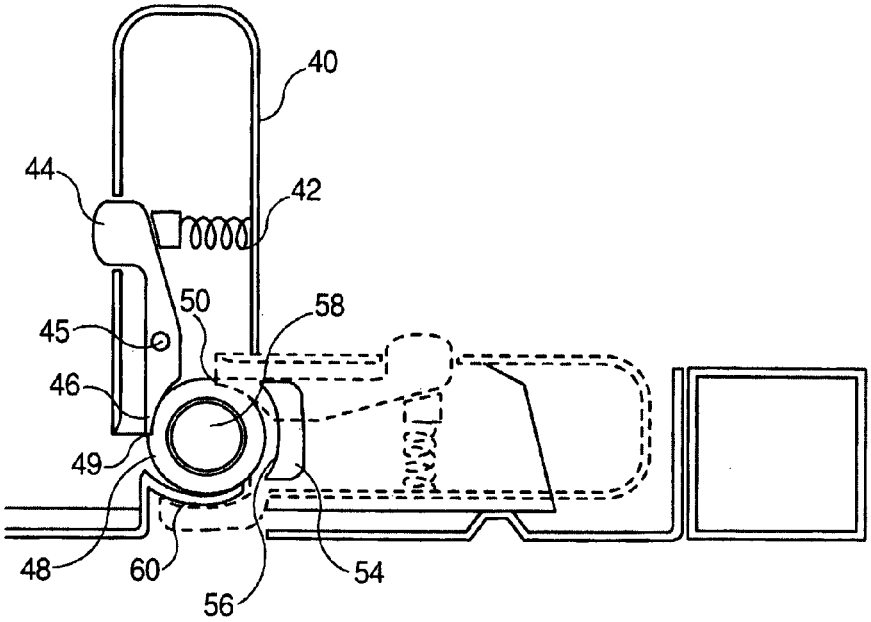
FIG. 5 shows a cross-section view of the handle of the ironing board in the use position and in the resting position.

When the user wants to use the iron 36, he or she must first place the handle 40 in the use position shown in FIG. 4. The handle in the resting position, shown with dotted lines in FIG. 5, is locked in the horizontal position. This locking is performed by means of a locking pushbutton 44 rotating about an axis and of which the end 46 is locked by a cam 48 having a first locking notch 49 for locking the handle in the use position and a second locking notch 50 for locking the handle in the resting position. The pushbutton is held in the locking position by means of a return spring 52. In order to unlock it, the user simply needs to press the button 44 and thus release its end 46 from the locking notch.

The handle 40 has, at its base, a locking hook 54 separated from the cam by a recess 56. When the user places the handle in the resting position (shown with dotted lines) after having pressed the pushbutton 44 in order to release the end 46 of the locking notch 49, the handle rotates by 90° about its axis 58. During this rotation, a stationary lug in the form of an arc of circle 60 is inserted into the recess 56 as shown in FIG. 5. After the pushbutton 44 is released, its end 46 becomes engaged in the locking notch 50. At this time, the iron is entirely immobilized by the lug 60 locked in the recess 56 and its handle is locked in the horizontal position.

The foldaway ironing device and its accessories described above has numerous advantages. Aside from the advantages already mentioned in document EP 2 167 721, it has, with respect to the foldaway assembly described in said document, the advantage of not having rotating mechanical parts and of having a much larger useful surface ratio of the ironing board with respect to the frame.

The invention claimed is:

1. Foldaway steam ironing device for ironing linens, including a frame (12) attached to the wall and forming a cavity (14) in which an ironing board is located, having a rear portion having an ironing surface (31) and a front portion (10) integral with the rear portion constituting a decorative surface or a mirror, said ironing board being capable of adopting a first position in which said front portion is visible in said frame attached to the wall and the rear portion is folded away, and a second position in which said front portion is folded away and said rear portion is made visible in said frame attached to the wall, said device having first pivoting means suitable for moving said ironing board from the first position to the second position and vice versa, and second pivoting means for moving said ironing board in the second position from the vertical position to the horizontal position as a bracket so that a user can use said ironing surface;

said device being characterized in that said ironing board is inside a mobile frame (18) pivoting by means of a top hinge and a bottom hinge located at the right-hand end or at the left-hand end of said frame attached to the wall and enabling said ironing board to pivot in the counterclockwise direction (or vice versa) about a vertical axis by an angle of around 90, and said first pivoting means include a top hinge and a bottom hinge located respectively in each of the horizontal portions of said mobile frame and at their middle, said hinges forming a vertical axis (20) enabling said ironing board to pivot in the clockwise direction (or vice versa) so as to make the rear portion of said ironing board, having an ironing surface, visible.

2. Device according to claim 1, wherein said second pivoting means consist, on the one hand, of two hinges located at the bottom of said ironing board and on each side of it integral with said mobile frame (18) so as to remove the ironing board from said mobile frame and flatten it out by pivoting it by 90°, and, on the other hand, a bracket support suitable for holding said ironing board in the horizontal position, having two arms (24 and 26) of which the lower ends (28 and 30) rest in the bottom portion of said mobile frame.

3. Device according to claim 1, wherein the two arms (24 and 26) of said bracket support each have a lug at their upper end, said lugs being held by sliding, respectively, into grooves (32 and 34) located under said ironing table, and reaching the end of said grooves when said ironing board has pivoted by 90° so that it is locked in the horizontal position.

4. Device according to claim 3, wherein holes are located in said grooves (32 and 34) and into which said lugs are inserted, which lugs are located at the upper end of said arms (24 and 26) urged by springs enabling said ironing board in the horizontal position to be immobilized in its working position.

5. Device according to claim 1, wherein an ironing appliance such as an iron (36) and/or a brush is located in the stowed position in a cavity at the end of said ironing board near the wall.

6. Device according to claim 5, also having a heating container generating steam connected by a steam duct to said ironing appliance.

7. Device according to claim 5, wherein said ironing appliance is an iron having a handle (40) and a soleplate (42), said handle being folded against said soleplate when said iron is stowed.

8. Device according to claim 7, wherein said handle (40) has a locking pushbutton (44) held in the locking position by means of a return spring (52), said pushbutton rotating about an axis (45) having its end (56) locked by a cam having a first locking notch (49) suitable for locking the handle in the use position and a second locking notch (50) suitable for locking the handle folded against said soleplate when the iron is stowed.

9. Device according to claim 5, wherein said ironing appliance is a brush implemented by the user by means of a gripping handle so as to cause it to glide over the linens to be ironed and enable quick ironing.

10. Device according to claim 5, having a heating container generating steam by means of a steam duct, and in which said ironing board having fans (38, 39) of which the rotation in a first direction enables steam to be propelled toward the outside of said ironing board and upward so that the steam coming from said steam duct passes through the linens placed on said board.

11. Device according to claim 10, wherein the rotation of the fans (38, 39) in a second direction enables an air flow directed downward to cause a suction, thereby enabling the linens to be ironed to be pressed on said ironing board and the action of said ironing appliance for ironing the linens to be largely facilitated, said ironing board having means for releasing the suctioned air.

* * * * *